United States Patent [19]

Madnick et al.

[11] Patent Number: 4,587,672

[45] Date of Patent: May 13, 1986

[54] COLD-WEATHER HAND COVERING HAVING SELECTIVELY SHAPED CHEMICAL HEATING ELEMENT RECEIVING CHAMBER

[75] Inventors: Herman Madnick; Ralph F. Goldman, both of Framingham, Mass.

[73] Assignee: Multi-Tech Corporation, Natick, Mass.

[21] Appl. No.: 643,020

[22] Filed: Aug. 22, 1984

[51] Int. Cl.[4] ..... A41D 19/00

[52] U.S. Cl. ..... 2/158; 2/159; 2/160; 2/164

[58] Field of Search ..... 2/158, 159, 160, 164

[56] References Cited

U.S. PATENT DOCUMENTS

| | | | |
|---|---|---|---|
| 2,103,594 | 12/1937 | Murray | 2/160 |
| 2,792,827 | 5/1957 | Gravin et al. | 2/159 X |
| 3,606,614 | 9/1971 | Dimitroff | 2/159 |
| 4,195,405 | 4/1980 | Monk | 2/158 |
| 4,247,097 | 1/1981 | Schwartz | 2/160 X |
| 4,326,706 | 4/1982 | Guthrie et al. | 2/160 X |
| 4,430,759 | 2/1984 | Jackrel | 2/164 X |

OTHER PUBLICATIONS

British Publication No. 2,118,023; 10-1983.

*Primary Examiner*—Werner H. Schroeder
*Assistant Examiner*—Judith L. Olds
*Attorney, Agent, or Firm*—Weingarten, Schurgin, Gagnebin & Hayes

[57] ABSTRACT

A cold-weather hand covering of the present invention includes a selectively shaped chemical heating element receiving chamber. In one embodiment, a fingerless glove hand covering having a substantially rectangular shaped chemical heating element receiving chamber confronting the palm side of the base of the fingers is disclosed. The fingers are warmed by so clenching the hand as to bring the fingers into direct heat receiving contact with the heating chamber, and heat transmitted thereby into the palm heats the blood and warms the fingers by circulation. In another embodiment, a mitt hand covering having a substantially heel-shaped chemical heating element receiving chamber confronting either the back surface or the front surface of the fingers including the fingertips is disclosed. The fingers are warmed directly by heat transmitted to the entire surface of the fingers and fingertips by the heel-shaped chemical heating element chamber. In a further embodiment, a glove hand covering having an articulated finger and thumb shaped chemical heating element receiving chamber confronting either the back surface or the front surface of the individual fingers and thumb is disclosed. The fingers and thumb are warmed directly by heat individually transmitted thereto by the articulated finger and thumb shaped chamber. In a further embodiment, a mitt hand covering having a hand-shaped chemical heating element receiving chamber confronting either the front or the back of the hand is disclosed. The fingers and thumb are collectively warmed directly by the hand-shaped chamber. In each of the disclosed embodiments, a selectively shaped chemical heating element is removably retained in the corresponding one of the selectively shaped chambers, and the several embodiments can advantageously be employed as either independent hand coverings or as liners.

19 Claims, 16 Drawing Figures

COLD-WEATHER HAND COVERING HAVING SELECTIVELY SHAPED CHEMICAL HEATING ELEMENT RECEIVING CHAMBER

FIELD OF THE INVENTION

This invention is directed to the field of apparel, and more particularly, to a novel cold-weather hand covering having a selectively shaped chemical heating element receiving chamber.

BACKGROUND OF THE INVENTION

Various hand coverings for actively supplying heat to the wearer's hands are known in the art. Such hand coverings are called upon to provide an efficient and safe source of heat while minimizing manufacturing, materials, labor, and end-user cost, and at the same time providing a hand covering that maximizes the dexterity and cold-weather comfort of the wearer. The heretofore known hand coverings are deficient in one or more of these and other aspects.

U.S. Pat. No. 2,792,827 (Gravin) discloses a glove having a liquid impermeable chamber integrally formed with the glove and confronting the back of the hand of a wearer thereof. A chemical is disposed into the chamber and combines with another chamber agent such as water causing an exothermic reaction the heat of which warms the hands of a wearer. Among other disadvantages, however, the glove has a comparatively complex and expensive construction, and charging and discharging the chamber with agent and water is both tedious and time consumptive and could result in unintended spillage induced soilage.

U.S. Pat. No. 4,970,081 (Eisendrath) discloses a hand covering having an integral pocket confronting the back of the palm portion of the hand of a wearer thereof for containing a chemical heating element. The chemical heating element has one cover-layer of water-impermeable material, and another cover-layer of water-permeable material. The heating element is activated by the addition of water through the water-permeable cover-layer, and kept inactive by reversing the heating element within the pocket in such a way that the water-impermeable layer is outwardly facing to prevent exposure to moisture. However, among other disadvantages, the pocket disposed on the back of the palm portion of a wearer's hand eliminates any possibility of directly warming the fingers, which are most subject to heat loss thereby subjecting the wearer to cold-weather discomfort, and the integral glove construction therein shown and described is both comparatively compex and expensive. U.S. Pat. No. 2,555,203 (Ramsey) discloses an archers' glove having a pouch for containing a chemical heating element similarly confronting the back of the palm portion of the hand, and is subject to like disadvantages.

U.S. Pat. No. 3,569,666 (Murphy) discloses an electrically-heated mitten that includes a pocket positioned over the back of the wearer's wrist to contain a battery. A flap-fastener for the battery pocket energizes the heating circuit, which includes a resistive metallic heating element in strip form sewn in place in an integral mitten liner adjacent the wearer's fingers. Among other disadvantages, the density and bulk of the wrist portion of the hand covering contributes to a loss of hand coordination. Additionally, the batteries can leak corrosive acids, and in some circumstances, can pose the threat of an undesirable if not harmful electric shock, particularly during wet weather.

U.S. Pat. No. 3,292,628 (Maxwell) discloses a therapeutic glove that includes a resistive heating element coiled between an integral liner and shell. The glove is energized through a line cord from a 110 V source. Among other disadvantages, the user is limited to usage within locations prescribed by the length of the line cord, a life-threatening shock hazard exists particularly where either the covered hand or glove becomes wet, and the therapeutic glove is both comparatively complex and expensive to manufacture.

SUMMARY OF THE INVENTION

The present invention contemplates a cold-weather hand covering having a selectively shaped chemical heating element receiving chamber, and further contemplates a selectively shaped chemical heating element. Means are contemplated for removably retaining the shaped element in its correspondingly shaped chamber. In one embodiment, a fingerless glove having a rectangular-shaped chemical heating element receiving chamber confronting the palm at the base of the fingers is disclosed. In this embodiment, the fingers may be pressed against a rectangular-shaped element received in the chamber both for directly warming the fingers and for indirectly warming the fingers by circulation of heated blood that is heated by pressing the hot chamber into the palm. In another embodiment, a mitten having a heel-shaped chemical heating element receiving chamber that conforms to the collective shape of the four fingers of a wearer is disclosed for providing maximum protection against cold to these vulnerable extremities. A heel-shaped chemical heating element is disposed in the heel-shaped chamber and positioned over the entire surface of the fingers including the fingertips and either confronting the palm side or the knuckle side of the hand of a wearer. In an additional embodiment, a mitt hand covering having a hand-shaped chemical heating element receiving chamber that warms the thumb and the four fingers of the wearer collectively is disclosed. In a further embodiment, a glove hand covering having an articulated finger and thumb-shaped chemical heating element receiving chamber that is so shaped as to warm the four fingers and thumb individually is disclosed.

The hand coverings of the several embodiments of the present invention are preferably sewn onto a conventional mitten or glove, and access to respective ones of the selectively shaped chambers is enabled by reversing the hand covering out of the mitten or glove in an inside-out condition. In each of the several embodiments, the correspondingly shaped chemical heating element is removably disposed in its associated selectively shaped chemical heating element receiving chamber, and is removably retained therein by any suitable means. Exemplary glove and mitten liners and other cold-weather hand covering constructions are disclosed.

BRIEF DESCRIPTION OF THE DRAWINGS

These and other features and advantages of the present invention will become apparent as the invention becomes better understood by referring to the following solely exemplary and non-limiting detailed description of the preferred embodiments, and to the drawings, wherein.

DETAILED DESCRIPTION OF THE PREFERRED EMBODIMENTS

Figure 1:
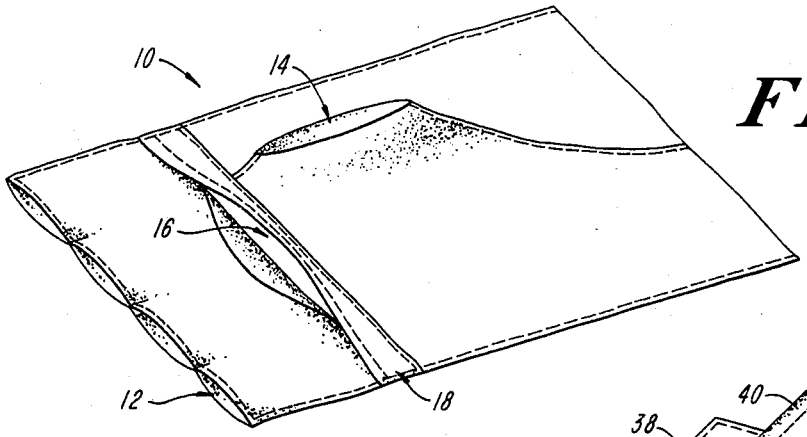
FIG. 1 is an isometric view of one embodiment of the cold-weather hand covering having a selectively shaped chemical heating element receiving chamber according to the present invention.

Referring now to FIG. 1, generally designated at 10 is a fingerless glove embodiment of the cold-weather hand covering having a selectively shaped chemical heating element receiving chamber according to the present invention. The fingerless glove 10 includes a plurality of finger receiving openings generally designated 12, a thumb receiving opening generally designated 14, and a selectively shaped chemical heating element receiving chamber generally designated 16 confronting the palm and positioned between the fingers and thumb of the right hand of a wearer. A releasable closure generally designated 18 is provided along the opening to the chamber 16.

Figure 2:
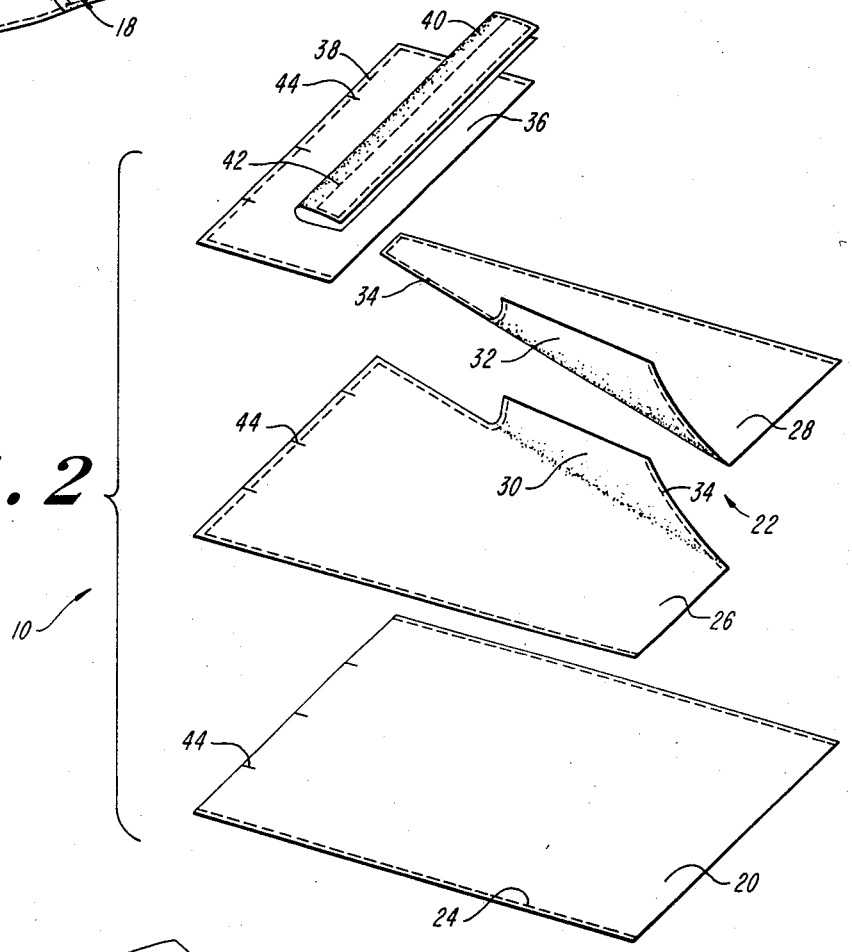
FIG. 2 is an exploded perspective view of the FIG. 1 embodiment of the cold-weather hand covering having a selectively shaped chemical heating element receiving chamber according to the present invention.

The fingerless glove 10 is fabricated of any suitable flexible material such as a leather, a fabric, or a vinyl and can be formed in any suitable manner to provide the elements 12, 14, 16 and 18. In preferred embodiments as best seen in FIG. 2, the fingerless glove 10 includes a unitary rectangular-shaped back-of-the-hand covering portion 20, and a two-piece palm-of-the-hand covering portion generally designated 22. The portions 20, 22 are joined together along confronting laterally outermost edges as by threads illustrated dashed at 24 to define a hand receiving covering that preferably extends from the base of the fingers to beyond the wrist of a wearer in the longitudinal direction.

The portion 22 includes a first member 26 that laterally extends across the fingers and across a part of the wrist for covering a portion of the palm, and a second member 28 that laterally extends across the index finger and the remaining part of the wrist for covering the remaining portion of the palm. Flaps 30, 32 are respectively provided along confronting sides of the members 26, 28 that are cooperative to define the thumb receiving opening 14 (FIG. 1) when the confronting edges of the members 26, 28 remote from the flaps 30, 32 are joined as by threads illustrated dashed at 34. A rectangular patch 36 is joined to the portion 22 adjacent the finger receiving end thereof as by threads illustrated dashed at 38. The patch 36 and the confronting wall of the portion 22 are cooperative to define the rectangular shaped chemical heating element receiving chamber 16 (FIG. 1). A folded-over strip 40 is joined to the portion 22 along a line thereof adjacent the opening of the rectangular shaped chamber 16 as by threads illustrated dashed at 42. The confronting edges of the members 36, 22, 20 along the finger receiving ends of the fingerless glove 10 are joined at spaced-apart points as by threads illustrated in solid line at 44 to define the finger receiving openings 12 (FIG. 1).

Figure 3:
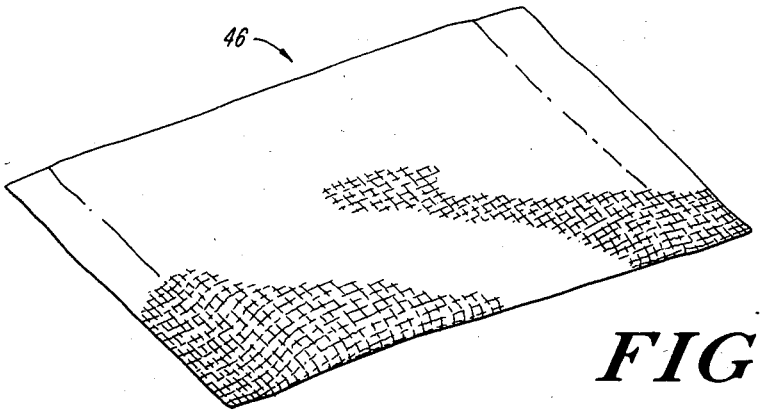
FIG. 3 is an enlarged isometric view of a selectively shaped chemical heating element for the FIG. 1 embodiment of the cold-weather hand covering having a selectively shaped chemical heating element receiving chamber according to the present invention.

In use, and referring now to FIGS. 1–3, a rectangular-shaped chemical heating element generally designated 46 is slidably inserted into the rectangular-shaped chemical heating element receiving chamber 16 of the fingerless glove 10. The strip 40 provides an abutment against which the element 46 is retained in the chamber 16. In the illustrated embodiment, the right hand of a wearer is slidably received in the glove 10 from the right in FIGS. 1, 2 with the thumb of the hand inserted through the thumb receiving opening 14, and with individual ones of the fingers of the hand slidably received through corresponding ones of the finger receiving openings 12. It will be appreciated that the fingers and the thumb are directly warmed by bending the fingers and/or the thumb into mechanical contact with the chemical heating element receiving chamber, and are indirectly warmed by so bending the fingers and/or thumb as to press the chemical heating element into the palm which thereby heats the blood and warms the fingers and the thumb by circulation of the heated blood.

Figure 4:
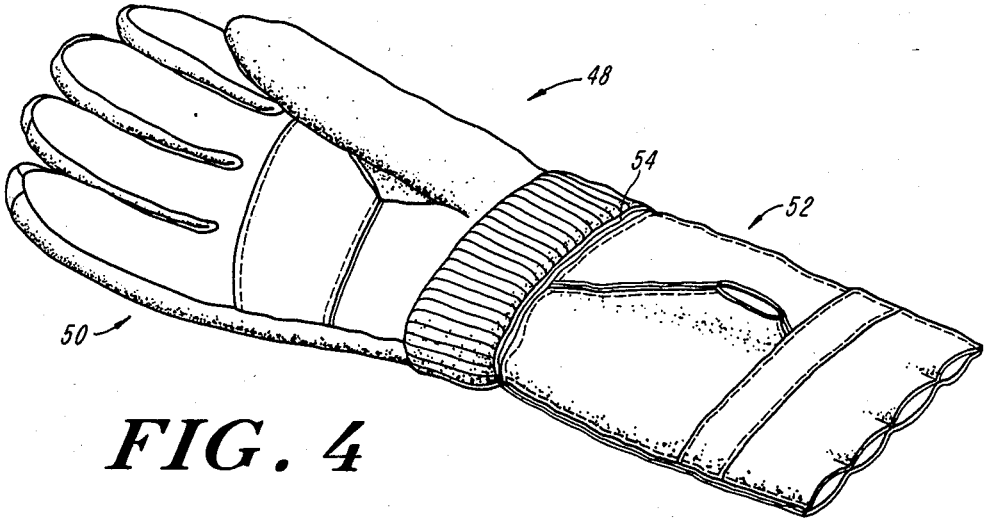
FIG. 4 is an isometric view illustrating another embodiment of the cold-weather hand covering having a selectively shaped chemical heating element receiving chamber according to the present invention.

Referring now to FIG. 4, generally designated at 48 is another embodiment of the cold-weather hand covering having a selectively shaped chemical heating element receiving chamber according to the present invention. The cold-weather hand covering 48 includes an outer glove generally designated 50 of any suitable material and construction, and a fingerless glove generally designated 52 of the type described above in connection with the description of FIGS. 1-3 joined thereto as by threads illustrated in solid line at 54. The fingerless glove 52 functions as a liner for the glove 50 and is illustrated in its inside-out condition. In the illustrated condition, a rectangular shaped chemical heating element, not shown, is removably inserted into the rectangular-shaped chemical heating element receiving chamber provided therefor, and the entire fingerless glove liner is then removably inserted inside the glove 50 for use during cold weather. It will be appreciated that in the embodiment of FIG. 4, the chemical heating element receiving chamber opens toward the palm when inserted inside the glove.

Figure 5:
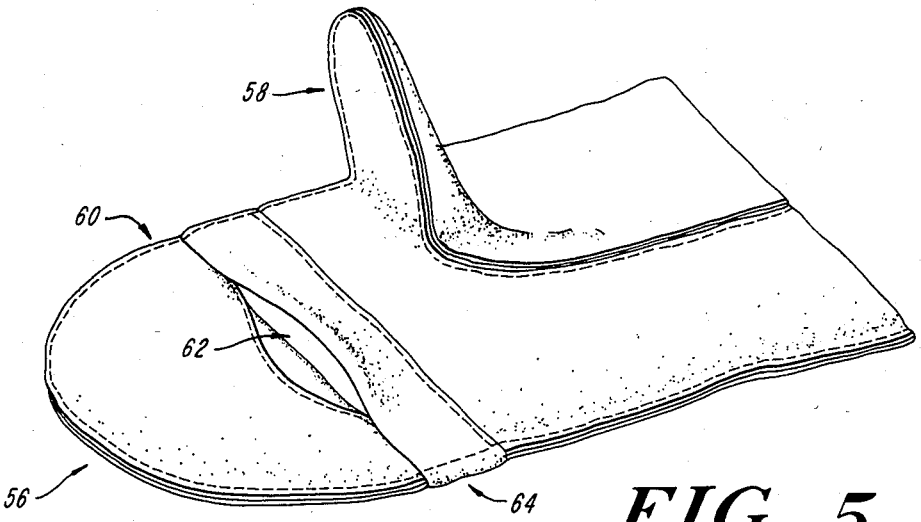
FIG. 5 is an isometric view illustrating a further embodiment of the cold-weather hand covering having a selectively shaped chemical heating element receiving chamber according to the present invention.

Referring now to FIG. 5, generally designated at 56 is a mitt illustrating another embodiment of the cold-weather hand covering having a selectively shaped chemical heating element receiving chamber according to the present invention. The mitt 56 includes a thumb-receiving chamber generally designated 58, a chamber generally designated 60 for receiving the fingers collectively, and a heel-shaped chemical heating element receiving chamber generally designated 62 that extends over the entire surface of the fingers from their fingertips to their jointure with the palm of the hand. A resealable closure generally designated 64 is provided across the opening of the heel-shaped chemical heating element receiving chamber 62.

Figure 6:
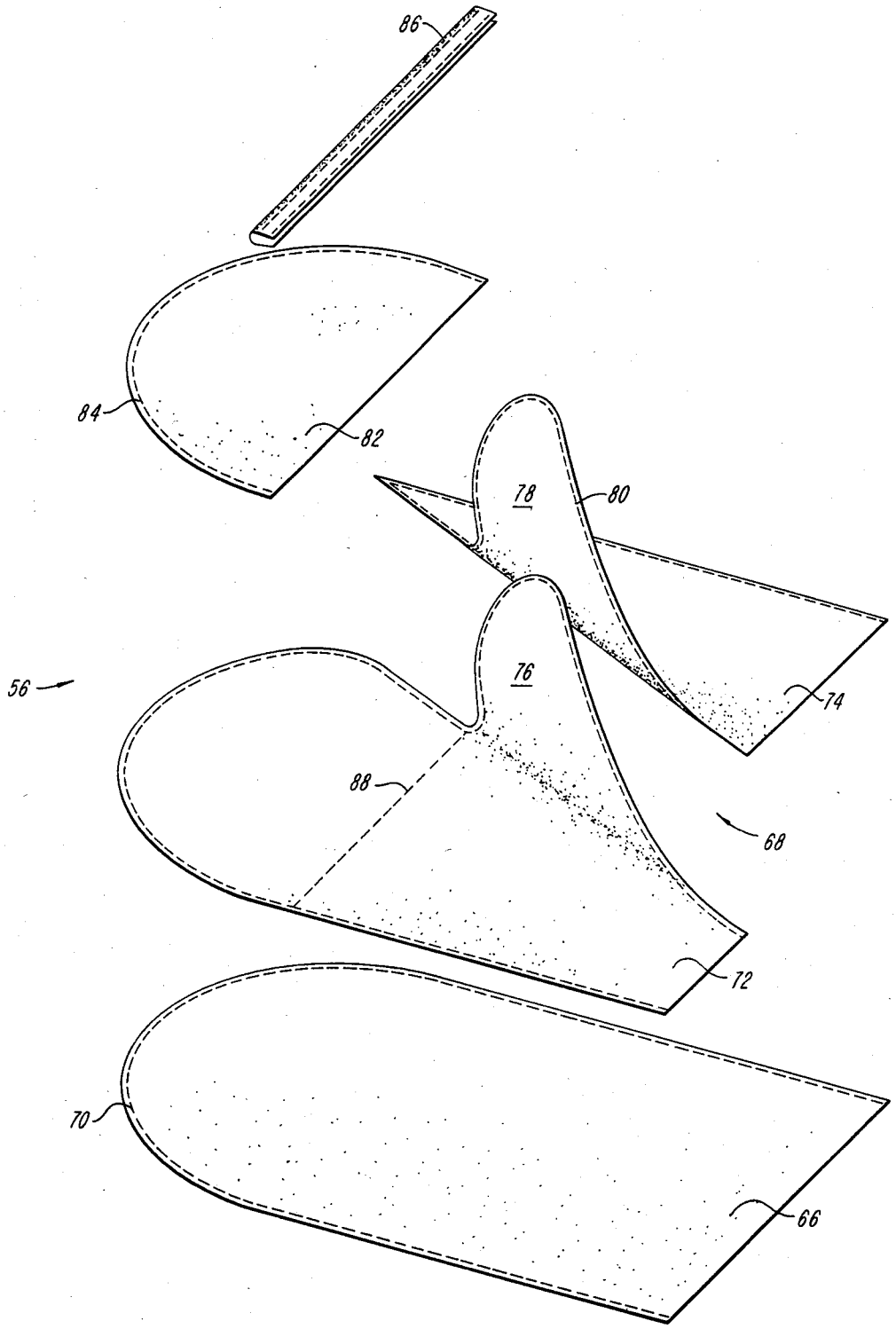
FIG. 6 is an exploded perspective view of the FIG. 5 embodiment of the cold-weather hand covering having a selectively shaped chemical heating element receiving chamber according to the present invention.

The mitt 56 can be fabricated of any suitable flexible material such as a fabric, a leather, or a vinyl, and can be formed in any suitable way to provide the elements 58, 60, 62, and 64. In preferred embodiment as best seen in FIG. 6, the mitt 56 includes a unitary bullet-shaped back-of-the-hand covering portion 66, and a two-piece palm-of-the-hand covering portion generally designated 68. The portions 66, 68 are joined together along the confronting edges of their outer perimeters as by threads illustrated dashed at 70. The portion 68 includes a first member 72 that covers the fingers and extends from the fingertips to the wrist covering a portion of the palm, and a member 74 that covers the top surface of the thumb and extends from the tip of the thumb to the wrist covering the remaining portion of the palm. Thumb-shaped flaps 76, 78 are respectively provided on confronting sides of the members 72, 74 that are joined along their confronting edges as by threads illustrated dashed at 80 to define the thumb receiving chamber 58 (FIG. 5). A heel-shaped flap 82 is joined to the member 68 along its arcuate periphery as by threads illustrated dashed at 84 defining the heel-shaped chemical heating receiving chamber 62 (FIG. 5). A folded-over strip 86 is joined to the portion 68 along a line thereof adjacent the opening of the heel-shaped chamber 62 (FIG. 5) as by threads illustrated dashed at 88 defining the resealable closure 64 (FIG. 5).

Figure 7:
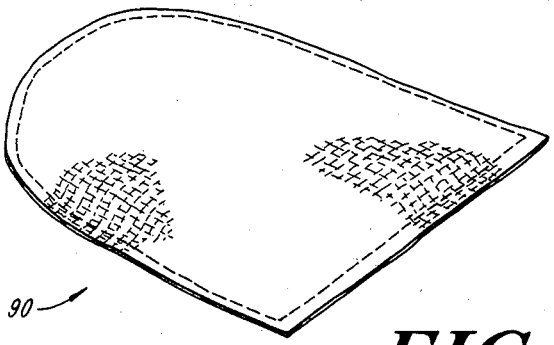
FIG. 7 is an isometric view of a selectively shaped chemical heating element for the FIG. 5 embodiment of the cold-weather hand covering having a selectively shaped chemical heating element receiving chamber according to the present invention.

In use, and referring now to FIGS. 5-7, a heel-shaped chemical heating element generally designated 90 is slidably received in the heel-shaped chemical heating element receiving chamber 62 of the mitt 56, and is removably retained therein by abutment against the strip 86 that laterally extends across the opening of the chamber 62. The heat produced by the heel-shaped chemical heating element warms the entire surface of the fingers from their fingertips to their jointure with the palm and on the palm side thereof. It will be appreciated that the heel-shaped chemical heating element receiving chamber, and the heel-shaped chemical heating element removably received therein, thereby provide maximum cold-weather comfort to the fingers of a wearer of the mitt 56.

Figure 8:
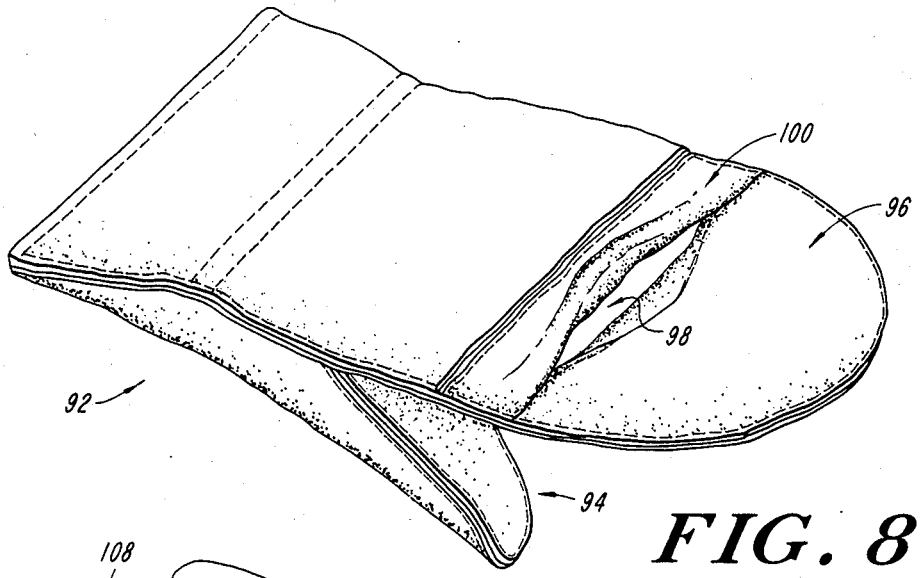
FIG. 8 is an isometric view illustrating a further embodiment of the cold-weather hand covering having a selectively shaped chemical heating element receiving chamber according to the present invention.

Referring now to FIG. 8, generally designated at 92 is a mitt illustrating another embodiment of the cold-weather hand covering having a selectively shaped chemical heating element receiving chamber according to the present invention. The mitt 92 includes a thumb receiving chamber generally designated 94, a chamber generally designated 96 for receiving the fingers collectively, and a heel-shaped chemical heating element receiving chamber generally designated 98 that extends over the entire surface of the fingers from their fingertips to their jointure with the back of the hand. A resealable closure generally designated 100 is provided across the opening of the heel-shaped chemical heating element receiving chamber 98.

The mitt 94 can be fabricated of any suitable flexible material such as a fabric, a leather, or a vinyl, and can be formed in any suitable manner to provide the elements 94, 96, 98, and 100. In preferred embodiment, the mitt 94 is advantageously formed as described above in connection with the description of FIG. 6, except that the heel-shaped patch thereof is joined about its arcuate perimeter with the confronting edge of the back-of-the-hand covering portion for defining the chemical heating element receiving chamber 98 confronting the back side of the fingers. It will be appreciated that the mitt 94 warms the entire surface of the fingers from their fingertips to their jointure with the back of the hand.

Figure 9:
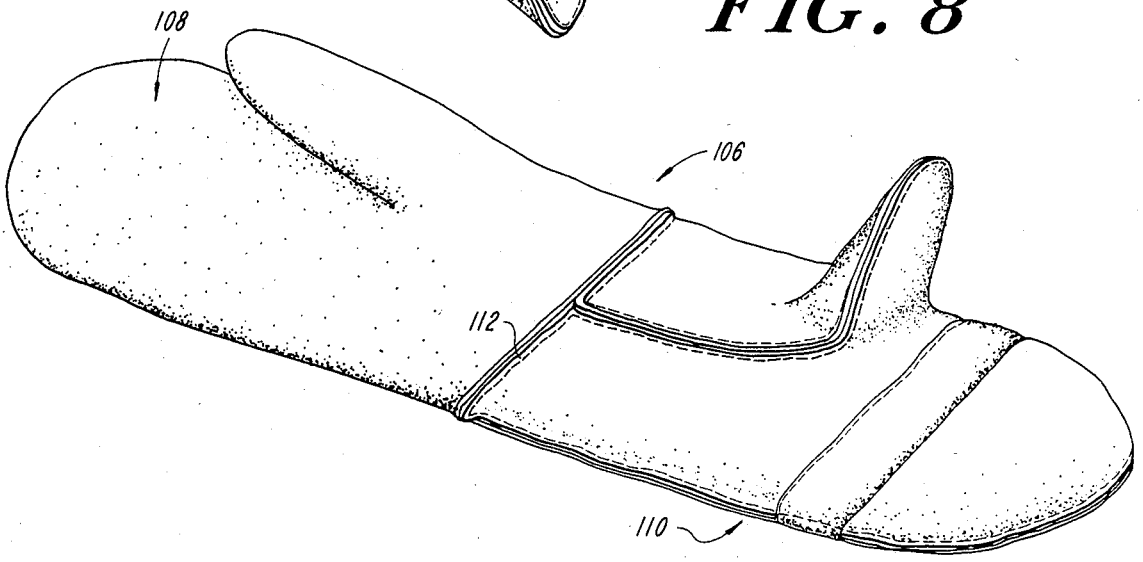
FIG. 9 is an isometric view illustrating another embodiment of the cold-weather hand covering having a selectively shaped chemical heating element receiving chamber according to the present invention.

Referring now to FIG. 9, generally designated at 106 is a mitt illustrating another embodiment of the cold-weather hand covering having a selectively shaped chemical heating element receiving chamber according to the present invention. The cold-weather hand covering 106 includes an outer mitt generally designated 108 of any suitable flexible material and construction, and a mitt-liner generally designated 110 of the type described above in connection with the description of FIGS. 5, 6, and 7 joined thereto as by threads illustrated in solid line at 112. In the illustrated inside-out condition of the mitt 106, the heel-shaped chemical heating element receiving chamber of the mitt liner 110 is readily accessible to removably insert the heel-shaped chemical heating element 90 (FIG. 7) thereinto and therefrom. When the mitt liner 110 is in its inside condition, not illustrated, it will be appreciated that the opening of the heel-shaped chemical heating element receiving chamber confronts and opens towards the palm-side of the fingers.

Figure 10:
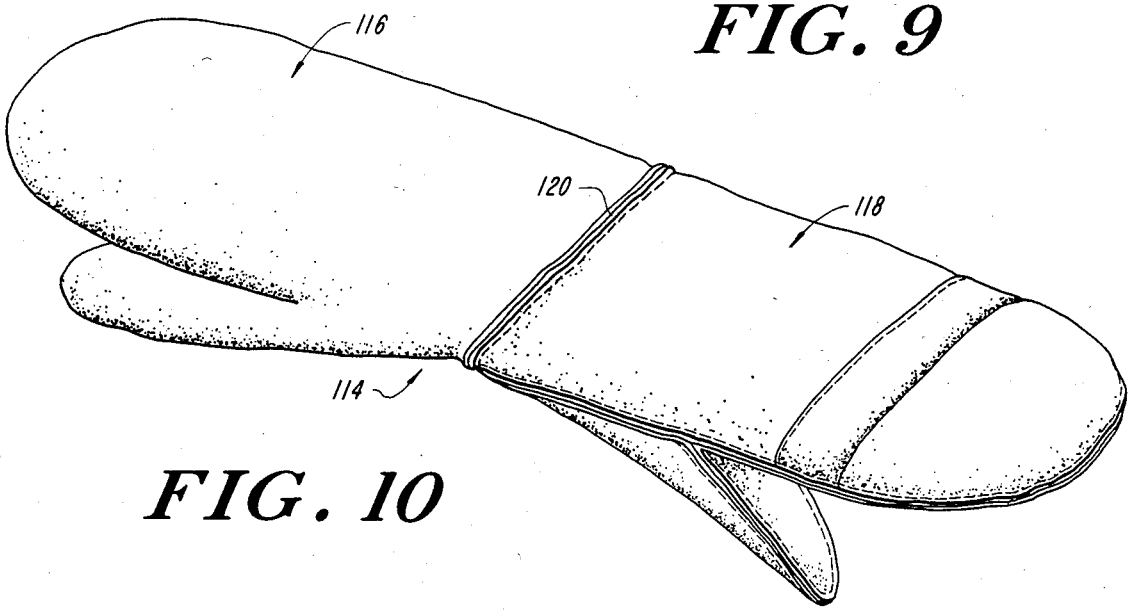
FIG. 10 is an isometric view illustrating another embodiment of the cold-weather hand covering having a selectively shaped chemical heating element receiving chamber according to the present invention.

Referring now to FIG. 10, generally designated at 114 is a mitt illustrating another embodiment of the cold-weather hand covering having a selectively shaped chemical heating element receiving chamber according to the present invention. The cold-weather hand covering 114 includes an outer mitt 116 of any suitable flexible material and construction, and a mitt-liner generally designated 118 of the type described above in connection with the description of FIGS. 7, 8 joined thereto as by threads illustrated in solid line at 120. The mitt-liner 118 in the illustrated inside-out condition of the mitt 14 allows the ready insertion and removal of the heel-shaped chemical heating element 90 (FIG. 7) into and out of the heel-shaped chemical heating element receiving chamber provided therefor on the back-side of the fingers and fingertips. It will be appreciated that in the inside condition of the liner 118, not illustrated, the heel-shaped chemical heating element receiving chamber confronts and opens towards the backside of the fingers.

Figure 11:
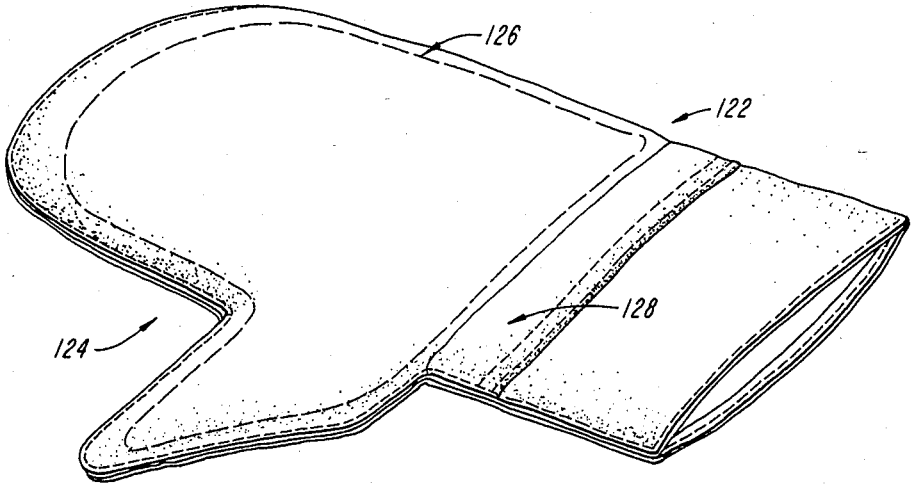
FIG. 11 is an isometric view illustrating a further embodiment of the cold-weather hand covering having a selectively shaped chemical heating element receiving chamber according to the present invention.
Figure 12:
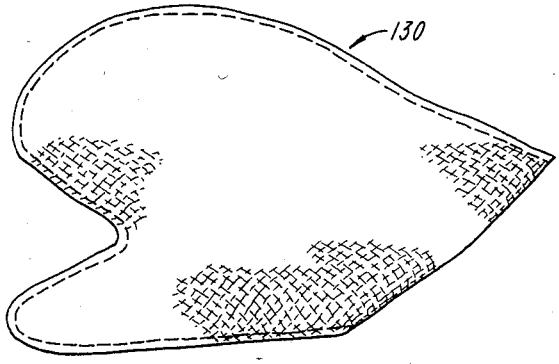
FIG. 12 is an isometric view of a selectively shaped chemical heating element for the FIG. 5 embodiment of the cold-weather hand covering having a selectively shaped chemical heating element receiving chamber according to the present invention.
Figure 15:
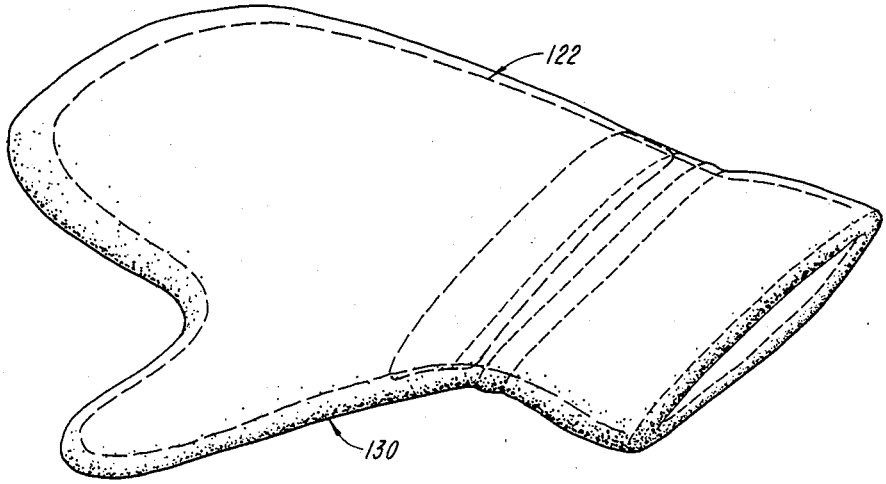
FIG. 15 is an isometric view illustrating a further embodiment of the cold-weather hand covering having a selectively shaped chemical heating element receiving chamber according to the present invention.

Referring now to FIG. 11, generally designated at 122 is a mitt illustrating another embodiment of the cold-weather hand covering having a selectively shaped chemical heating element receiving chamber according to the present invention. The cold-weather hand covering 122 includes a chamber generally designated 124 for receiving the four fingers and thumb collectively, a hand-shaped chemical heating element receiving chamber schematically illustrated in dashed outline generally designated 126, and a resealable closure generally designated 128 extending across the opening of the hand-shaped chemical heating element receiving chamber. The hand covering 122 can advantageously be fabricated of any suitable flexible material such as a fabric, a leather, or a vinyl, and can be formed in any suitable manner to provide the elements 124, 126, and 128. The hand-shaped chemical heating element receiving chamber can advantageously be formed confronting either the back-side or the palm-side of the hand of a wearer. In one presently preferred embodiment, the mitt 122 can advantageously be formed of three hand-shaped layers of flexible material that are joined along their periphery to provide the elements 124, 126 of the mitt 122. A hand-shaped chemical heating element generally designated 130 in FIG. 12 is slidably received in the hand-shaped chemical heating element receiving chamber 126 (FIG. 11), which warms the entire surface of the fingers and thumb. As in the embodiments illustrated in FIGS. 4, 9, and 10, the cold-weather hand covering 122 can advantageously be used with an outer mitt generally designated 130 schematically illustrated in its inside-condition inside the mitt 130 in FIG. 15.

Figure 13:
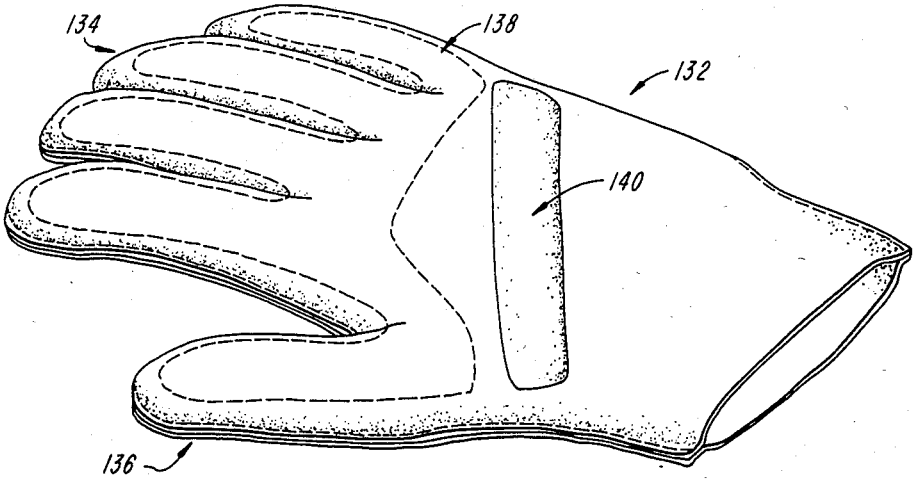
FIG. 13 is an isometric view illustrating a further embodiment of the cold-weather hand covering having a selectively shaped chemical heating element receiving chamber according to the present invention.
Figure 14:
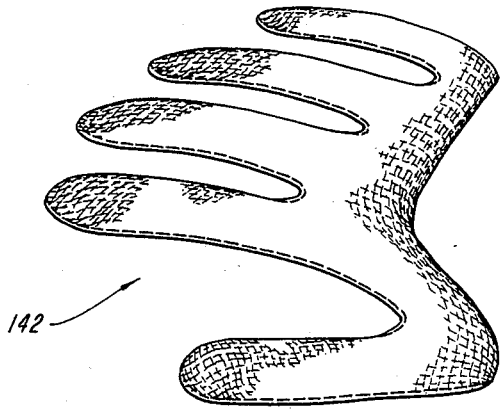
FIG. 14 is an isometric view of a selectively shaped chemical heating element for the FIG. 13 embodiment of the cold-weather hand covering having a selectively shaped chemical heating element receiving chamber according to the present invention.
Figure 16:
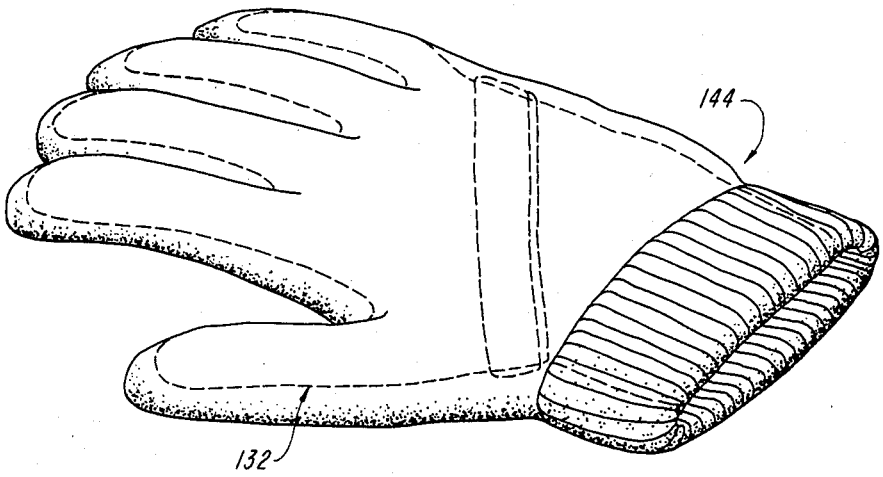
FIG. 16 is an isometric view illustrating a further embodiment of the cold-weather hand covering having a selectively shaped chemical heating element receiving chamber according to the present invention.

Referring now to FIG. 13, generally designated at 132 is a glove illustrating another embodiment of the cold-weather hand covering having a selectively shaped chemical heating element receiving chamber according to the present invention. The cold-weather hand covering 132 includes a plurality of finger receiving chambers generally designated 134 for receiving corresponding ones of the fingers of a wearer, a thumb receiving chamber generally designated 136 for receiving the thumb of a wearer, and an articulated finger and thumb-shaped chemical heating element receiving chamber illustrated in dashed outline generally designated 138. A resealable closure 140 is provided laterally across the opening of the articulated finger and thumb-shaped chemical heating element receiving chamber 138. The glove 132 can be fabricated from any suitable flexible material such as a leather, a vinyl, or a fabric, and can be formed in any suitable manner to provide the elements 134, 136, 138, and 140. The articulated finger and thumb-shaped chemical heating element receiving chamber 138 can advantageously be formed confronting either the back-side or the palm-side of the hand of a wearer. In one presently preferred embodiment, the glove 134 can advantageously be formed of three articulated finger and thumb-shaped layers of flexible material that are joined along their peripheries, in such a way that the shaped chamber is defined between one outer layer and the middle layer, and the hand receiving chamber is defined between the middle layer and the other outer layer. An articulated finger and thumb-shaped chemical heating element generally designated 142 in FIG. 14 is slidably received in the articulated finger and thumb-shaped chemical heating element receiving chamber 138 for warming the confronting surface of corresponding ones of the fingers and thumb of a wearer. As in the embodiments of FIGS. 4, 9, 10, and 15, the glove 132 can advantageously be used as a liner for an outer glove schematically illustrated generally at 144 in FIG. 16 in its inside condition inside the glove 144.

Many modifications of the presently disclosed invention will become apparent to the those skilled in the art without departing from the scope of the appended claims.

What is claimed is:

1. Apparatus for actively supplying heat to the hands of a wearer, comprising:

an outer cold weather hand covering that is made of a water and wind resistant material and having a peripheral wall defining an opening for receiving the hand;

an inner liner dimensioned to be removably insertable into said outer cold-weather hand covering;

said inner liner including a hand receiving shell that is made of a fabric material and having a peripheral wall defining an opening for receiving the hand therethrough;

said liner including fabric means coupled to said hand receiving shell and cooperative with said shell for providing a selectively shaped chemical heating element receiving chamber having an opening;

said liner including a resealable closure coupled to said hand receiving shell and proximate said opening of said chamber for releasably retaining a selectively shaped chemical heating element slidably insertable into said chamber; and means coupled between said peripheral wall of said cold-weather hand covering and said peripheral wall of said hand receiving shell for mounting said liner for sliding motion into and out of said cold-weather hand covering so that it actively supplies heat to the hand when inside the outer covering and permits access to the chamber when it is outside the covering.

2. The invention of claim 1, wherein said hand receiving shell is a fingerless glove liner, and said chamber has a rectangular geometry.

3. The invention of claim 2, further including a rectangular-shaped chemical heating element that matches the shape of said rectangular chemical heating element receiving chamber, and wherein said chemical heating element receiving chamber is positioned across the palm and intermediate the jointure of the fingers of a wearer and the thumb of a wearer.

4. The invention of claim 2, wherein said covering is a cold-weather glove, and wherein said fingerless glove liner is joined to said cold-weather glove in such a way that it is slidably insertable thereinto and thereout.

5. The invention of claim 1, wherein said hand receiving shell is a full glove liner, and wherein said selectively shaped chemical heating element receiving chamber has an articulated finger and thumb shape.

6. The invention of claim 5, further including an articulated finger and thumb shaped chemical heating element that matches to the shape of said articulated finger and thumb-shaped chemical heating element receiving chamber.

7. The invention of claim 6, wherein said hand covering is a cold-weather glove, and wherein said full glove liner is joined to said glove in such a way that it is slidably insertable thereinto and thereout.

8. The invention of claim 1, wherein said hand receiving shell is a full mitt-liner, and wherein said selectively shaped chemical heating element receiving chamber has a heel-shape.

9. The invention of claim 1, wherein said hand receiving shell is a mitt-liner, and wherein said selectively shaped chemical heating element receiving chamber has a heel-shape and confronts the palm-side of the hand of a wearer.

10. The invention of claim 1, wherein said hand receiving shell is a mitt-liner, and wherein said chemical heating element receiving chamber has a heel-shape and confronts the back-side of the hand of a wearer.

11. The invention of claim 9, further including a heel-shaped chemical heating element that conforms to the shape of said heel-shaped chemical heating element receiving chamber.

12. The invention of claim 10, further including a heel-shaped chemical heating element that conforms to the shape of said heel-shaped chemical heating element receiving chamber.

13. The invention of claim 9, wherein said heel-shaped chemical heating element receiving chamber confronts the entire palm-side of the fingers and extends from the fingertips to the jointure of the fingers with the hand of a wearer.

14. The invention of claim 10, wherein said heel-shaped chemical heating element receiving chamber confronts the entire back-side of the fingers and extends from the fingertips to the jointure of the fingers with the hand of a wearer.

15. The invention of claim 9, wherein said hand covering is a cold-weather mitt, and wherein said mitt-liner is joined to said cold-weather mitt in such a way that it is slidably insertable thereinto and thereout.

16. The invention of claim 10, wherein said hand covering is a cold-weather mitt, and wherein said mitt-liner is joined to said cold-weather mitt in such a way that it is slidably insertable thereinto and thereout.

17. The invention of claim 1, wherein said hand-receiving shell is a full mitt-liner, and wherein said selectively shaped chemical heating element receiving chamber has a hand-shape that confronts the surface of the fingers collectively and that confronts the thumb.

18. The invention of claim 17, further including a hand-shaped chemical heating element that conforms to the shape of said hand-shaped chemical heating element receiving chamber for warming the fingers collectively from their fingertips to proximate their jointure with the base of the hand, and for warming the thumb from its top to its jointure with the base of the hand.

19. The invention of claim 17, wherein said hand covering is an outer cold-weather mitt, and wherein said full mitt liner is joined to said outer mitt in such a way that it is removably insertable thereinto and thereout.

* * * * *